US008939366B1

(12) United States Patent
Kelly

(10) Patent No.: US 8,939,366 B1
(45) Date of Patent: Jan. 27, 2015

(54) TARGETING DISPLAY SYSTEM AND METHOD

(71) Applicant: John T. Kelly, Murrieta, CA (US)

(72) Inventor: John T. Kelly, Murrieta, CA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 177 days.

(21) Appl. No.: 13/658,681

(22) Filed: Oct. 23, 2012

(51) Int. Cl.
*G06F 19/00* (2011.01)

(52) U.S. Cl.
USPC ..... 235/400; 235/404; 235/414

(58) Field of Classification Search
USPC ..... 235/400, 404, 414
See application file for complete search history.

(56) References Cited

U.S. PATENT DOCUMENTS

2010/0282845 A1* 11/2010 Peters et al. ..... 235/414
2012/0097741 A1* 4/2012 Karcher ..... 235/404

* cited by examiner

*Primary Examiner* — Karl D Frech
(74) *Attorney, Agent, or Firm* — Angel N. Gerdzhikov; Donna P. Suchy; Daniel M. Barbieri

(57) ABSTRACT

Systems and methods for displaying information on a targeting display are provided. A method comprises positioning a targeted object proximate a center of a targeting display image and providing a reticle below the target object. The reticle is configured to identify the targeted object to a user of the targeting display. The method further comprises providing a first plurality of data elements positioned along a vertical axis upon which the targeted object and reticle are also positioned. The first plurality of data elements include a range to the target, an azimuth to the target, and one or more error estimates relating to at least one of the range to the target or the azimuth to the target. The method further comprises providing a second plurality of data elements within a plurality of areas positioned proximate to one or more borders of the targeting display image.

22 Claims, 6 Drawing Sheets

TARGETING DISPLAY SYSTEM AND METHOD

BACKGROUND

The present disclosure relates generally to the field of targeting display systems.

Targeting displays are configured to illustrate a targeted object, or object of interest, within a field of view. For example, a targeting display associated with a weapons system may be configured to display one or more targets upon which the weapons may be utilized. Some targeting displays may be configured to provide data relating to the targeting display and/or the target in the same display image as the targeted object. As additional information is provided within the display image, the field of view around the targeted object and/or the targeted object itself may be obscured by the information.

SUMMARY

One embodiment of the disclosure relates to a method of displaying information on a targeting display. The method comprises positioning a targeted object proximate a center of a targeting display image and providing a reticle below the target object in the targeting display image. The reticle is configured to identify the targeted object to a user of the targeting display. The method further comprises providing a first plurality of data elements positioned along a vertical axis upon which the targeted object and reticle are also positioned. The first plurality of data elements include a range to the target, an azimuth to the target, and one or more error estimates relating to at least one of the range to the target or the azimuth to the target. The method further comprises providing a second plurality of data elements within a plurality of areas positioned proximate to one or more borders of the targeting display image.

Another embodiment relates to a system comprising an electronic processor configured to position a targeted object proximate a center of a targeting display image and to provide a reticle below the target object in the targeting display image. The reticle is configured to identify the targeted object to a user of the targeting display. The processor is further configured to provide a first plurality of data elements positioned along a vertical axis upon which the targeted object and reticle are also positioned. The first plurality of data elements include a range to the target, an azimuth to the target, and one or more error estimates relating to at least one of the range to the target or the azimuth to the target. The processor is further configured to provide a second plurality of data elements within a plurality of areas positioned proximate to one or more borders of the targeting display image.

Another embodiment relates to one or more computer-readable storage media having instructions stored thereon that are executable by one or more processors to execute a method. The method comprises positioning a targeted object proximate a center of a targeting display image and providing a reticle below the target object in the targeting display image. The reticle is configured to identify the targeted object to a user of the targeting display. The method further comprises providing a first plurality of data elements positioned along a vertical axis upon which the targeted object and reticle are also positioned. The first plurality of data elements include a range to the target, an azimuth to the target, and one or more error estimates relating to at least one of the range to the target or the azimuth to the target. The method further comprises providing a second plurality of data elements within a plurality of areas positioned proximate to one or more borders of the targeting display image.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
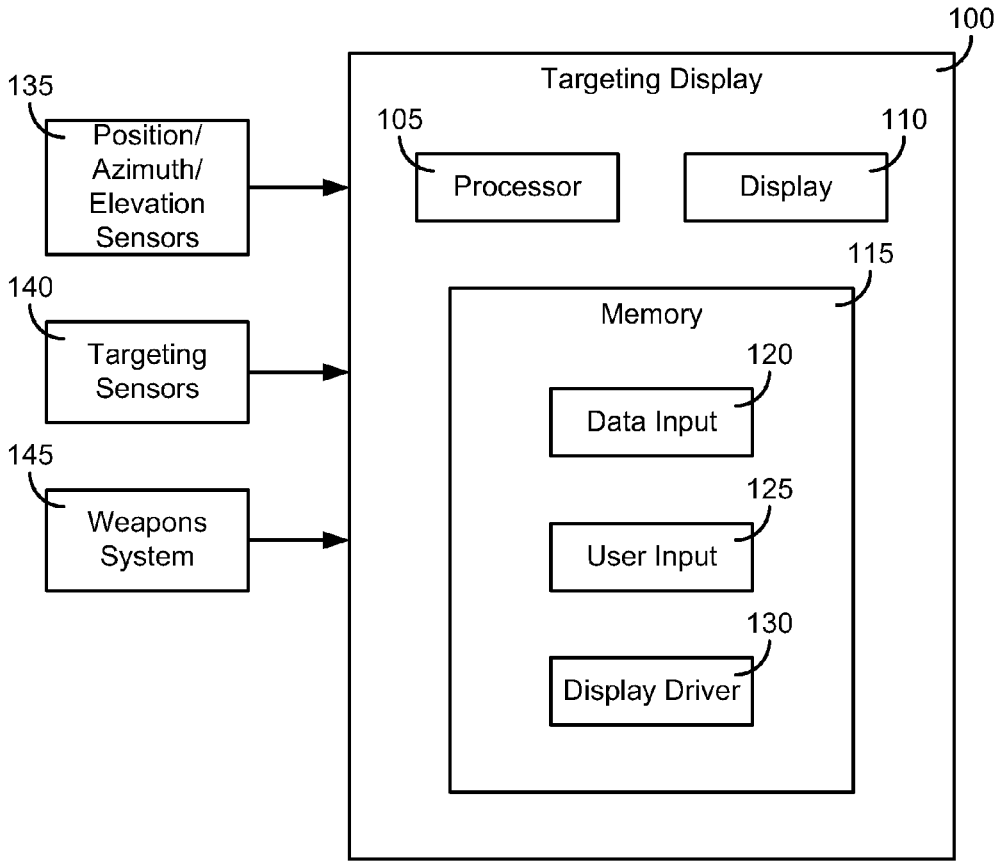
FIG. 1 is a block diagram of a targeting display system that may be used to display information relating to one or more targeted objects according to an exemplary embodiment.

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting. As discussed below, the systems and methods can be utilized in a number of control devices for various types of applications or analyzed systems.

Referring generally to the figures, systems and methods for presenting information on a targeting display are provided. Integrated field of view display interfaces according to the various exemplary embodiments provided herein are intended to resolve the presentation of significant and cognitively challenging information relevant to an observation and targeting operational scenario performed visually by a human user. In some embodiments, the embodiments presented herein may be applied to a targeting display for use in conjunction with a weapons system and may display information relating to an object targeted by the weapons system. However, the embodiments of the present disclosure may be applied to any and all situations in which a view of an intended object of interest is desired and in which related information or data (from associated systems to the viewing device) is intended to be viewed as well. In some embodiments, when a view is intended to be maintained to monitor changes or other aspects of the object of interest and information or data is intended to be entered by the user, the system may allow the user input while retaining the existing view of the object and not fully obscuring the view.

Various approaches to presenting a field of view around a targeted object and related information may involve the presentation of a targeting or alignment reticle and variations of presentations of data in textual, graphical, and/or symbolic forms. Some challenges that exist in presenting such information include the retention of the field of view with minimal obscuration (e.g., such that the information does not cover too much of the targeted object and field of view) and enabling high cognitive comprehension by the user of the targeting display. Some targeting displays are configured in such a way that data is presented in a manner that is confusing to the user (e.g., due to the amount, placement, color, frequency, etc. of the data) or is not aligned with the other elements presented in the display image in a useful way. Some approaches may address only first order information of either the object or the user (e.g., location, range, direction, elevation, etc.) while the inclusion of additional high value data (e.g., accuracy and error estimations, result of effect estimations, relative and absolute locations of surrounding objects of interest, system status, user interactivity cues, etc.) is either overlooked, not presented uniformly or entirely, presented in alternative displays requiring sighting away from the field of view, or blocking/overlaying into the field of view.

The present disclosure provides exemplary systems and methods that present information to the user in a way that is non-intrusive to the view of a targeted object and surrounding field of view and provides high value information in a useful alignment for the user. Various features of the present disclosure that may be utilized alone or in combination with one another include a minimized centering reticule, visually aligned object/target information display areas, and optionally selectable (via user or process) semitransparent elements for selectively persistent data. Embodiments of the disclosure may be configured to present a significant array of relevant information and data in such a way that the user's field of view is fully or largely retained regardless of what display field/area is populated or selected. The use of minimal symbology reticles and defined area information retains high cognitive awareness by the viewing user of what data is relevant and how to apply/act on the data. The integrated display view may be interfaced using various modality user actions (e.g., physical buttons, touch screen display, voice input, etc.) and may not be dependent on any single modality. In some embodiments, a first set of data elements (e.g., data relating to the targeted object and/or a relationship between the targeting display and the targeted object, such as a position of the targeted object, range and/or azimuth from the targeting display to the targeted object, error data relating to these values, etc.) may be presented in a same vertical plane as the targeted object and/or the reticle in the display image. A second set of data elements (e.g., position of the targeted object and/or targeting display, error information, status information, etc.) may be presented near a border of the display image.

Referring now to FIG. 1, a block diagram of a targeting display system 100 is shown according to an exemplary embodiment. System 100 is configured to receive information relating to one or more targeted objects and to display the information on a display 110 in a manner such that a large amount of relevant, high value information is presented in a single display image and a large field of view (FOV) around the targeted objected in retained. Exemplary embodiments described below may be described with respect to an application in which system 100 is used to display target information for a weapons system of an aircraft. The pilot of the aircraft may use such a system to evaluate whether to use a particular weapon on an identified target. In some embodiments, system 100 may be utilized to provide weapons targeting information for other types of vehicles and/or applications, such as helicopters, tanks, trucks, and/or other land-based vehicles, devices carried by human operators (e.g., hand-held devices, laptop computers, etc.), etc. In some embodiments, system 100 may be used for applications other than the targeting of weapons, including any applications in which it is desirable to display information relating to an intended object of interest in a same display image as the object of interest.

System 100 includes at least one processor 105 configured to receive instructions from a memory 120 and to execute the features of system 100 based on the instructions. Processor 105 may include any general or special purpose processor (e.g., FPGA, CPLD, ASIC, etc.). Memory 120 may include any machine-readable storage medium configured to store machine-readable instructions or program code (e.g., RAM, ROM, hard drive, flash memory, optical storage, etc.).

Memory 120 may include one or more modules associated with different functions of system 100. A data input module 120 may be configured to receive data to be displayed on display 110 from systems and/or sensors associated with and/or connected to system 100. For example, data input module 120 may receive data associated with system 100 and/or a vehicle or system to which system 100 is coupled (e.g., an aircraft) from sensors 135. In an implementation in which system 100 is coupled to or included within an aircraft, sensors 135 may be configured to provide information relating to a position of the aircraft (e.g., a position sensor), an altitude of the aircraft (e.g., an altimeter), a heading or bearing of the aircraft, (e.g., an inertial or magnetic heading sensor), an azimuth of the aircraft, error estimates relating to one or more of these values, etc.

Data input module 120 may be configured to receive data relating to one or more targeted objects from targeting sensors 140. Targeting sensors 140 may be or include radar systems and/or other systems configured to scan an area around system 100 and to identify objects of interest that may be targeted by system 100. Information that may be received from targeting sensors 140 may include, for example, a position of a target object, an elevation of the target object, an azimuth and/or range from system 100 to the target object, a bearing of the target object, a speed and/or acceleration of the target object, etc.

In implementations in which system 100 is utilized in conjunction with one or more weapons systems 145, data input module 120 may be configured to receive data relating to the weapons and the potential effects of the weapons, if used, from the weapons system 145. Weapons may include, for example, projectiles that are not designed to explode upon impact with an object, explosive devices, explosive projectiles, etc. Data received from weapons system 145 may include, for example, information relating to types of weapons available for deployment, a number of a particular type of weapon with which the vehicle is currently equipped, a status of the weapon system (e.g., armed/ready, standby, disarmed, error or fault, etc.), data relating to the potential impact on the target object and/or an area around the target object that may be impacted if the weapon is deployed, any identified friendly targets in the vicinity of the selected target object that are at risk of being affected if the weapon is deployed, etc. In various exemplary embodiments, system 100 may be configured to receive input from any other types of sensors and/or systems that provide data that a user may find useful in relation to targeted objects shown on display 110.

In some embodiments, system 100 may allow a user to select what data elements are shown and hidden in display images presented on display 130. A user input module 125 may be configured to receive input from one or more user input devices (e.g., a touchscreen display, one or more buttons or keys, a voice input system, etc.) For example, a user may choose to display information regarding range and azimuth to a selected target but not error information relating to those values. The user may choose to display detailed information regarding available weapons systems for a portion of time and to hide the information at other times. In some embodiments, user input module 125 may allow a user to enable or disable the display of any data element presented within the same display image as the target object and surrounding field of view. In this manner, the user may decide how much information is desired during different times and/or under different circumstances and, if a particular data element is not desired, the user may hide or remove the element to maximize the visible field of view around the target object. A display driver 130 may be configured to translate data into signals that may be interpreted by display 110 to produce graphical output images.

Figure 2:
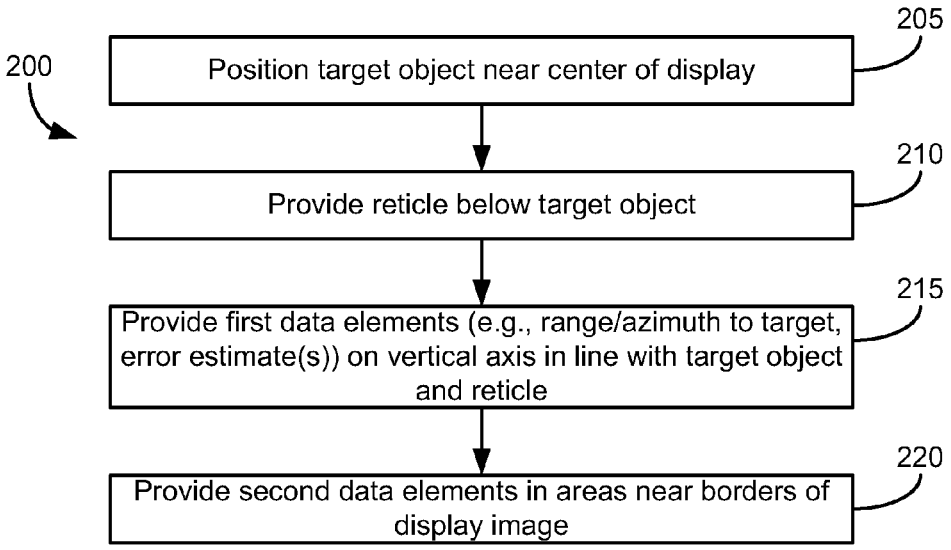
FIG. 2 is a flow diagram of a process for providing information on a targeting display according to an exemplary embodiment.

Referring now to FIG. 2, a flow diagram of a process 200 for presenting information on a targeting display is shown according to an exemplary embodiment. In some embodiments, process 200 may be carried out using one or more components of targeting display system 100. It should be appreciated that the operations of process 200 may be performed in any order.

System 100 may be configured to receive information regarding the one or more target objects and to position a selected target object proximate to a center (e.g., a horizontal and/or vertical center) of display 110 (205). System 100 may provide a reticle below the target object that quickly identifies for the user the position of the object that is currently being targeted in the display image (210). In some embodiments, the reticle may be configured such that it covers a small portion of the area near the center of the display image and does not substantially obscure the target object or the field of view in the nearby vicinity of the target object.

System 100 may be configured to provide a first set of data elements on a vertical axis in line with the target object and reticle (215). In some embodiments, the first set of data elements may include data relating to the target object and/or the relationship between system 100 and the target object, such as a position of the target object and/or a range and/or azimuth from system 100 to the target object. In some embodiments, the first set of data elements may include error estimate information, such as an estimate of the potential error in the azimuth or range from system 100 to the target object. In some embodiments, system 100 may connect the first set of data elements using a visible line. This may help a user identify information considered to be important to a targeting operation. In some embodiments, the user may be allowed to enable and disable the vertical line and/or one or more of the first set of data elements.

A second set of data elements may be presented in areas designed to avoid substantially obscuring the field of view near the target object, such as areas proximate to outer borders of the display image (220). In some embodiments, information such as status information, system error estimates, position, elevation, and/or bearing information for system 100, weapons system information, and/or other information may be selectively displayed as part of the second set of data elements.

Figure 3:
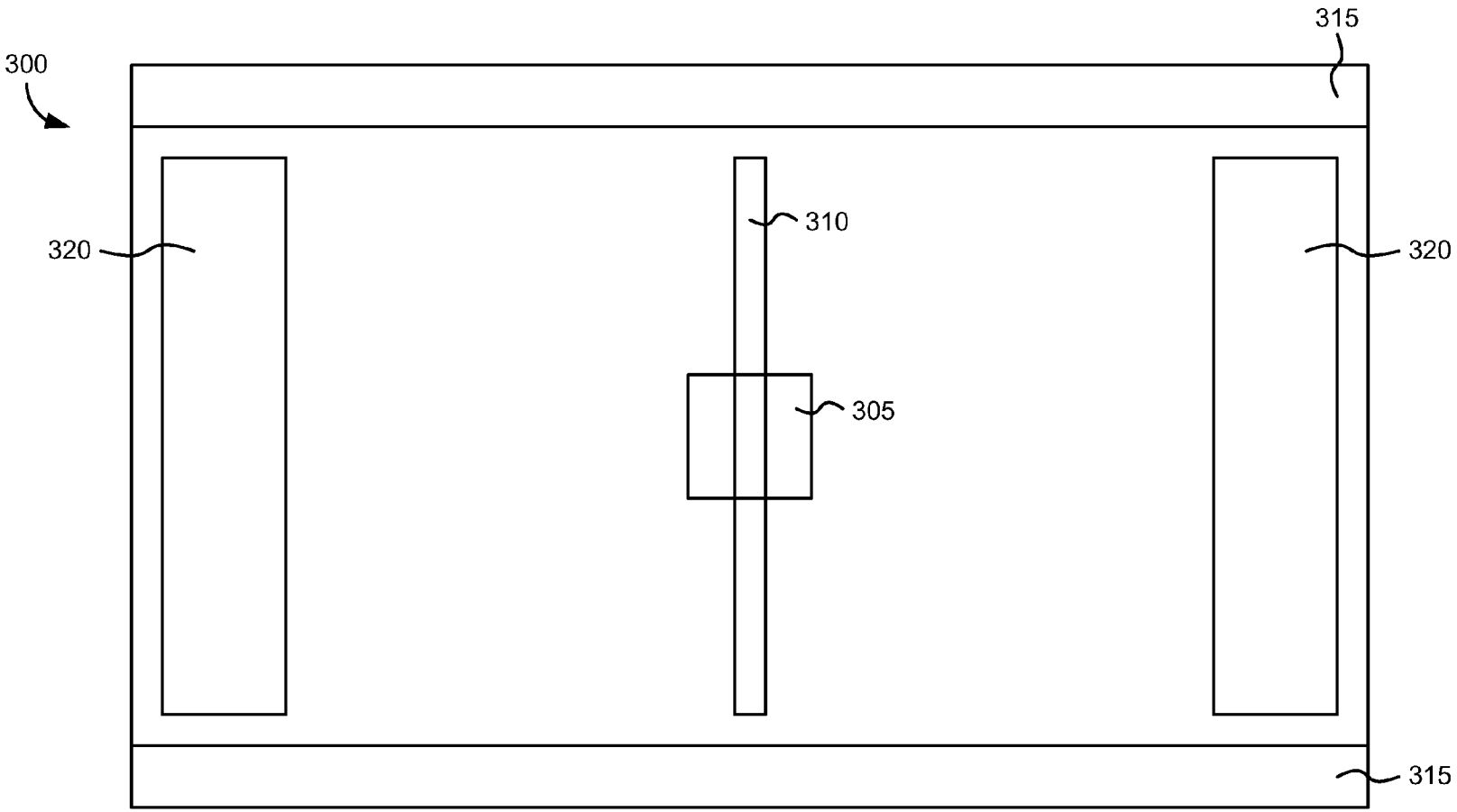
FIG. 3 is an illustration of information areas or zones in a targeting display image according to an exemplary embodiment.

Referring now to FIG. 3, an illustration of information areas or zones in a targeting display image 300 is shown according to an exemplary embodiment. Image 300 is configured to display information in particular zones in an effort to provide most or all key information in a unified single display form while retaining a maximal field of view with minimal clutter to increase the cognitive understanding of the user. The organization of information placement in image 300 is designed to retain minimal blockage of the true center of the field of view (e.g., where the target object may be displayed).

Area 305 of image 300 may be configured to display the target object and/or a reticle designed to quickly identify the target object to the user. This area may be positioned on or near a center of image 300 (e.g., horizontal and/or vertical center) and may be the primary focus area of a user. Information considered to be of high importance to a user may be positioned in a "sight line" area 310, which may be placed along a vertical axis containing the target object and/or reticle. Information placed in area 310 may include information considered important in user decision making relating to the targeted object, such as range and azimuth to the targeted object and error information related to the relative position/orientation of the targeting display and the targeted object. Areas 315 located near the top and bottom borders of image 300 may include important status and position information, system error estimate information, etc. Areas 320 located near the left and right borders of image 300 may include optional information that may be application-specific (e.g., weapons-related data). It should be appreciated that any type of information may be displayed in each of areas 310, 315, and 320 according to various exemplary embodiments. In some embodiments, the targeting display system may allow a user to specify what types of information will appear in which of areas 310, 315, and 320 and/or to selectively enable and disable the display of various types of information. In various embodiments, the information provided in areas 310, 315, and 320 may include, but is not limited to, user position, user alignment to true North, user elevation, target object position, target object alignment to true North and/or the user, target object elevation to true sea level, the user, and/or artificially selectable levels, relative locations (e.g., in range and azimuth) of all selected target objects and the user to the user and/or true North, system information, data, and status, and/or other functional specifics that may be tailored to particular applications. In various embodiments, image 300 and other images described herein may be configured for presentation using color, grayscale, and/or black and white formats. The images may be scalable to various form factors and types of display devices (e.g., monitors). The languages and/or symbology utilized to represent data within the images may vary and may be user and/or system-configurable.

Figure 4:
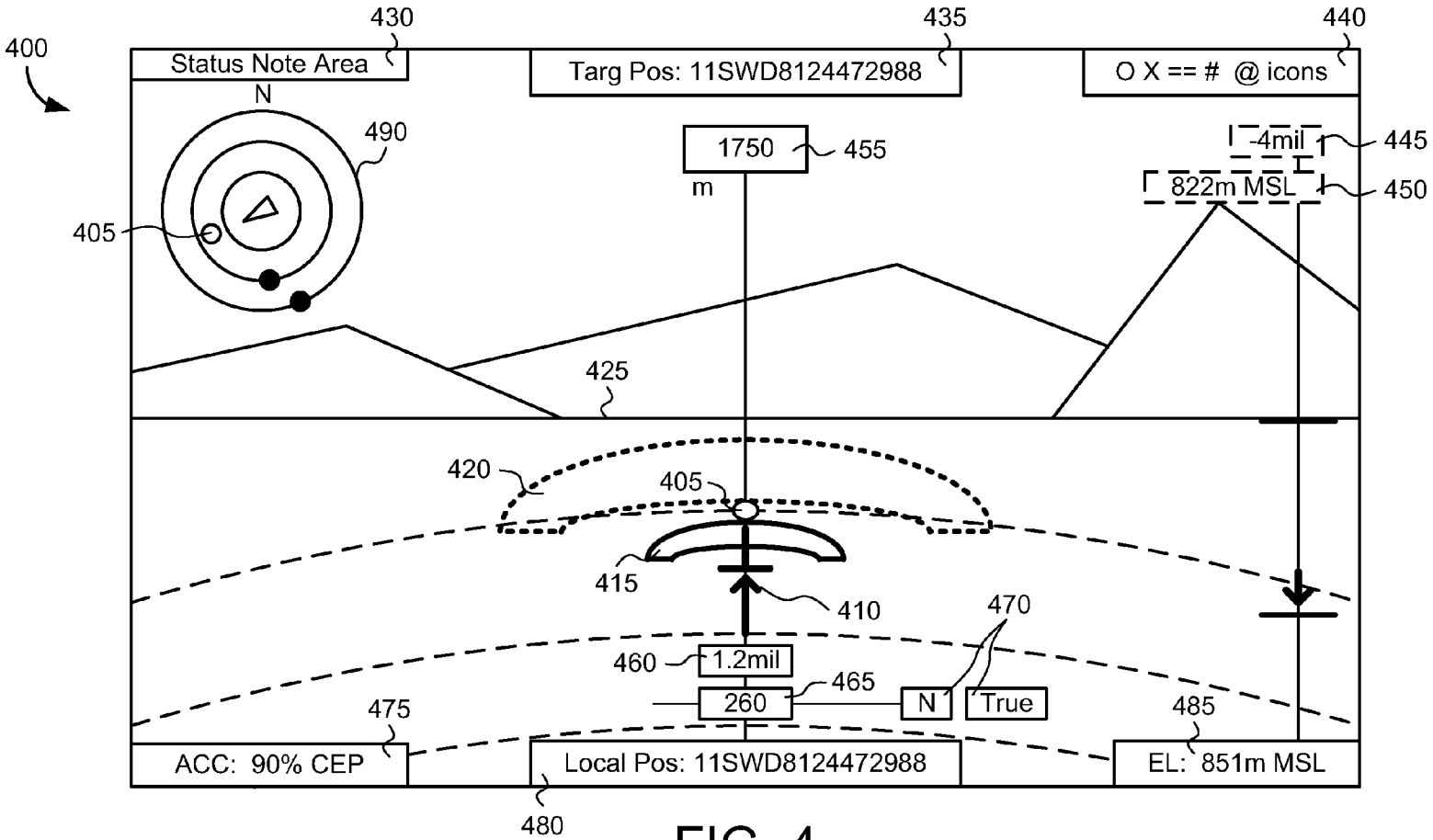
FIGS. 4-6 are illustrations of targeting display images according to exemplary embodiments.

Referring now to FIG. 4, an illustration of a targeting display image 400 is shown according to an exemplary embodiment. Image 400 may be an image that is displayed, for example, on a targeting display in an aircraft for targeting weapons on one or more objects. In other embodiments, images having features similar to image 400 and other images described herein may be utilized for other applications and/or in conjunction with other devices or vehicles. While certain units for various types of data may be specified below, it should be understood that many data items may be additionally or alternatively expressed in other types of units. In some embodiments, some or all of the data provided in image 400 may be provided in user-defined or user-selectable units.

A targeted object 405 may be displayed near a center (e.g., horizontal and/or vertical center) of image 400. In the illustrated exemplary embodiment, targeted object 405 is illustrated as a small circle. In other embodiments, targeted object 405 may include an illustration of the actual object (e.g., a building, vehicle, item, etc.). Underneath targeted object 405 is shown a reticle 410 configured to highlight to the user the position of targeted object 405 in image 400. Reticle 410 is graphically produced on display image 400 in one embodiment. In the illustrated embodiment, reticle 410 includes a horizontal bar positioned underneath targeted object 405 and an arrow pointing to the center of the horizontal bar to identify a horizontal center of targeted object 405. Reticle 410 may be centered (e.g., horizontally centered) in the field of view. Reticles utilized in targeting displays are often large, complex, and obscure the view of the targeted object and immediately surrounding field of view. Reticle 410, as illustrated, is designed to rapidly guide the user's sight to the object of interest (e.g., in the center of the field of view) while not obscuring targeted object 405 unnecessarily. Reticle 410 may typically be retained in image 400 during normal use but, in some embodiments, may be removed/hidden by the user if desired. In some embodiments, reticle 410 may have an "inverse bar" design including the arrow, horizontal bar, and a vertical bar extending upward from the horizontal bar to the object. In various embodiments, the vertical bar and/or arrow may be provided at a right side, left side, or center of the horizontal bar. In some embodiments, a horizontal thin bar/line may be provided that scales across image 400 to populate the view in line with the horizontal bar of reticle 410.

In some embodiments, image 400 may include a horizon indicator 420 configured to assist the user in determining a relative artificial horizon (e.g., zero elevation point) with respect to the targeting display system. Horizon indicator 420 may be provided with respect to a hard horizon line 425 illustrated in image 400 and may present a rapid visual anchor to the artificial horizon referenced to the user's alignment/tilt of the view. In some embodiments, horizon indicator 420 may include a different shape, such as a single curved line, to further minimize obstruction of the view around targeted object 405.

Image 400 includes a plurality of data fields organized at locations in image 400 in a manner to maximize the field of view that can be seen by the user while providing important data to the user. A first set of data fields may be organized along a vertical axis of targeted object 405 and/or reticle 410 (e.g., a horizontally centered vertical axis). The vertical axis may be a natural sight line for a user of the targeting display system and may allow the user to see important information in a same line of sight as targeted object 405, such that the user does not need to shift focus far away from targeted object 405 to see the information provided along the vertical axis.

In the illustrated exemplary embodiment, a range field 455 presented near the top of image 400 along the vertical axis provides a range from the targeting display system to targeted object 405 (e.g., in meters, kilometers, feet, yards, miles, etc.). An azimuth field 465 provided near the bottom of image 400 along the vertical axis identifies the relative or absolute azimuth from the user to targeted object 405 in selected units (mil, degrees, etc.). Vertically centered on azimuth field 465 is a small horizontal line crossing the box containing azimuth field 465 from left to right to which an azimuth information field 470 containing a floating 'N' (for North) is applied on either the left or right side to indicate which way/direction North is. In some embodiments, the horizontal line may fill approximately the same area as the optional horizon indicator 420. In some embodiments, the N may float towards the box containing azimuth field 465 when turning to North until the box containing the N overlays at centered North. A second azimuth information field 470 may be located in horizontal alignment to azimuth field 465 to indicate whether the selected azimuth is true North (the direction toward the geographic North Pole, which follows the curvature of the Earth), grid North (a vertical line on a map running parallel to the prime meridian that does not follow the curvature of the Earth), or otherwise.

An azimuth error field 460 shown just above azimuth field 465 provides an estimate of the error in the azimuth displayed in azimuth field 465, as determined by the targeting system, targeting display system, user, etc., in selected units (e.g., mils, degrees, percentage of displayed azimuth measurement, etc.). In some embodiments, error estimates may be selectively displayed (e.g., upon user selection) for some or all of the other values displayed in the targeting image, such as for the range displayed in range field 455. Such error estimates may be provided by the system or sensor from which measurement associated with the error is received, provided by a user via an input interface, generated by the targeting display system, or received from another system or sensor. In some embodiments, image 400 may include a visual error indicator 415 proximate to reticle 410 and/or targeted object 405 providing a graphical illustration to the user of the estimated error in the range and/or azimuth calculations. In some embodiments, error indicator 415 may additionally or alternatively be based on other error estimate values, such as an estimate of the error in a position determination for the targeting display system and/or targeted object 405. In some embodiments, a vertical bar or line may be used to connect some or all of the data elements aligned along the vertical axis to anchor the data (e.g., range data field 455) together.

A second set of data fields may be organized at locations near outer borders of image 400 to provide information to the user without substantially impeding the field of view around targeted object 405. A status message field 430 shown in the upper-left corner of image 400 may provide status messages regarding various systems and/or sensors includes within and/or connected to the targeting display system, such as position sensors, azimuth sensors, elevation sensors, targeting sensors, weapons systems, vehicle information systems, etc. Status message field 430 may be configured to display any status messages from the various systems and/or sensors, such as a message that the systems and/or sensors are operational and ready, in a standby mode, in a fault mode (e.g., where one or more steps should be taken before the systems and/or sensors will function correctly), etc. A status symbol field 440 shown in the upper-right corner of image 400 may provide symbols or icons representing different status messages of such systems and/or sensors (e.g., the same or different messages shown in status message field 430).

In some embodiments, positioning information regarding the target and/or the user/targeting display system may be included within the second set of data fields. A target position field 435 presented near an upper-center portion of image 400 identifies the position of targeted object 405 in selected units (e.g., latitude/longitude, Military Grid Reference System (MGRS) units, etc.). A local position field 480 presented near a lower-center portion of image 400 identifies the position of the user/targeting display system. A user elevation field 485 presented in a lower-right portion of image 400 identifies an elevation of the user/targeting display system (e.g., in feet or meters above mean sea level (MSL)). A system error field 475 presented in a lower-left portion of image 400 provides an indicator of the accuracy of the targeting system with selectable units, such as circular error probable (CEP) (e.g., a measure of circular positional accuracy in percentage of samples that would fall within a particular circular area around the identified position of targeted object 405).

In the illustrated exemplary embodiment, information regarding the elevation of targeted object 405 is presented near a right border of image 400. A target elevation field 450 provides an elevation of targeted object 405 in selected units (e.g., mils, feet, meters, degrees, etc.). A target elevation error field 445 provided above target elevation field 450 provides an estimated error associated with the value presented in target elevation field 450. In the illustrated embodiment, a vertical thinner bar/line that scales from the bottom to approximately ⅔ to the top of image 400 is optionally available to anchor the object elevation data and error data. Additionally, the illustrated bar/line includes two small horizontal indicators with one in a fixed location aligned with hard horizon line 425 (e.g., indicating true zero elevation tilt (true horizon)) and the other sliding to align with the center of reticle 410 as a visual cue aligned to elevation. A pointing arrow is also optional to touch the slider and indicate the direction away from the zero horizon elevation.

In some embodiments, a relative position map 490 may be provided as illustrated near the upper-left area of image 400 that shows the user/targeting display system as relative center (e.g., illustrated as a triangle pointing in the direction of the point of view shown in image 400) surrounded by range rings. The range rings illustrate relative distances extending outward from a current position of the user. In some embodiments, the units and/or distances associated with the range rings may be user-selectable. Any number of rings may be provided as part of relative position map 490 (e.g., 1, 3, 5, etc.). The user direction may be indicated by use of a 'pointing' symbol (triangle) and unit indicator ('N' for true north shown) in which the relative azimuth from North may be quickly understood graphically. In some embodiments, the user azimuth may be held in the 'up' position with the relative location graphics then presented only relative to the user's current orientation regardless of North. The relative locations of selectable items (e.g., waypoints) may be overlaid on the range rings at their relative distances and azimuths from the user using the appropriate azimuth (North or user) reference. Shaping, shading, coloring, etc. may be applied for additional information presentation of the relative locations (circle, square, triangle, etc). In the illustrated exemplary embodiment, targeted object 405 is illustrated as an unfilled circle to indicate that targeted object 405 has been selected for targeting and other identified objects in relative position map 490 are illustrated as solid, filled circles to indicate that the objects are not currently selected for focus in the image 400. In some embodiments, a user may select an object in relative position map 490 to make the object the new focus of image 400. Optionally, in relative position map 490, when the object being sighted is being targeted (user/system is determining range, location, azimuth, elevation) in the central field of view, a small relative action circle around the new object relative position symbol may be overlaid, demonstrating to the user the immediate relative location to the user of the object.

Figure 5:
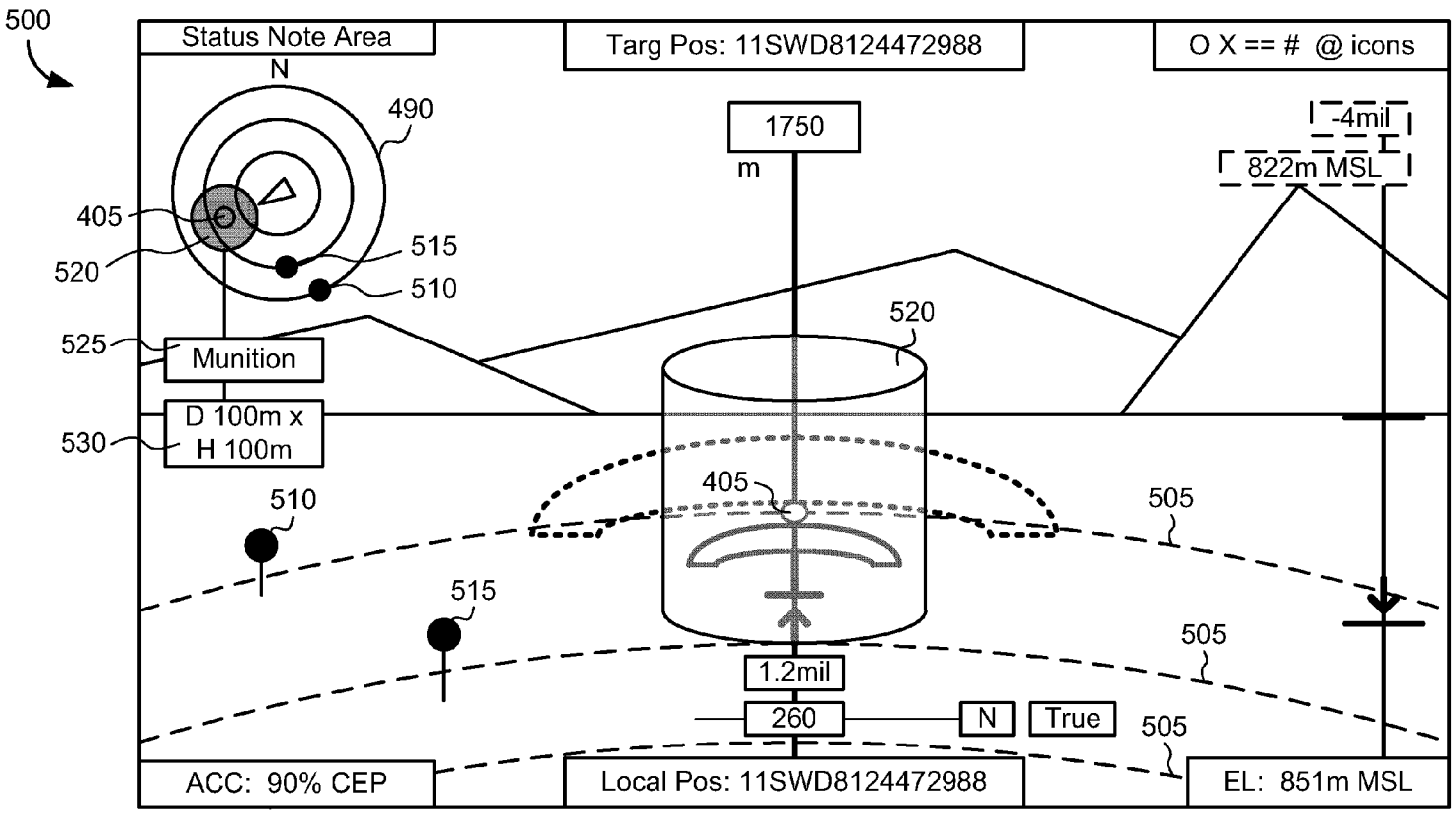

Referring now to FIG. 5, a targeting display image 500 is shown that includes the data shown in image 400 and also includes additional information regarding objects in view that are not currently the central focus of image 500 and information relating to one or more weapons systems. A plurality of range rings 505 are shown extending from a point of view of the user in image 500 at relative distances corresponding to the distances between range rings in relative position map 490. Range rings 505 may be shown as circular lines radiating outward from the user's implied position (e.g., bottom center of view) out towards the artificial horizon, each of which indicate a radius of range or distance from the user outward. The division between rings may be user/system selectable. The range rings can be used in conjunction with overlays (using symbols/icons) of relative objects/positions of interest selected by the user/system that are represented relatively from the user's position in terms of distance and azimuth. In the illustrated embodiment, objects 515 and 510 are shown at appropriate positions within range rings 505 based on their relative positions with respect to the position and orientation of the user. The object locations may mimic relative position map 490 (which is a top down implementation) but present a 'virtual view' perspective of nearby objects within the direct field of view. The implementation of this approach may provide additional immediate visibility to nearby to target objects, enhancing detection of conditions of nearby friendly fire opportunities. In some embodiments, any selected object within a user/system determined range of any other selected object/waypoint can trigger an alert to the user in the status/information view.

Image 500 includes a user-selectable weapon effect indicator 520 that may be used to demonstrate a calculated effect (e.g., in terms of area and height) and may be overlaid (e.g., fully or partially transparently) at the center of the field of view centered on targeted object 405 and/or reticle 410 (e.g., centered vertically and/or horizontally). Weapon effect indicator 520 may demonstrate a size/volume of effect (e.g., interpreted as potential damage due to applied explosive or other effect) based on the user/system selected effect (e.g., weapon choice such as an indirect munition). In the illustrated embodiment, a graphical representation of weapon effect indicator 520 is also provided in relative position map 490. A cylinder is used as weapon effect indicator 520 in the illustrated embodiment; in other embodiments, other shapes (e.g., squares/cubes, circles, spheres, etc.) may be used. A weapon type field 525 may be provided to inform the user as to the type of weapon/munition currently selected and a weapon effect field 530 may provide a measure of numeric dimensions of the area that may be affected if the weapon is used. Both the numeric dimensions and the appearance of weapon effect indicator 520 may be determined based on the type of weapon selected. Both weapon information boxes may be offset to the side to again not clutter the center of view.

In some embodiments, weapon effect indicator 520, weapon type field 525, and/or weapon effect field 530 may be configured to display information related to a sensor or other system-based effect that is not necessarily a weapon. For example, weapon effect indicator 520, weapon type field 525, and/or weapon effect field 530 may be configured to demonstrate a calculated effect from any other types of sensors and/or systems that provide data that a user may find useful in relation to targeted objects and be similarly overlaid in the field of view and represented in relative position map 490. In one exemplary embodiment, weapon effect indicator 520, weapon type field 525, and/or weapon effect field 530 may be configured to provide information relating to a non-lethal "dazzle" radius (e.g., an area in which a stunning device may have a stunning effect, or a confusion of the senses, on one or more systems or operators).

Figure 6:
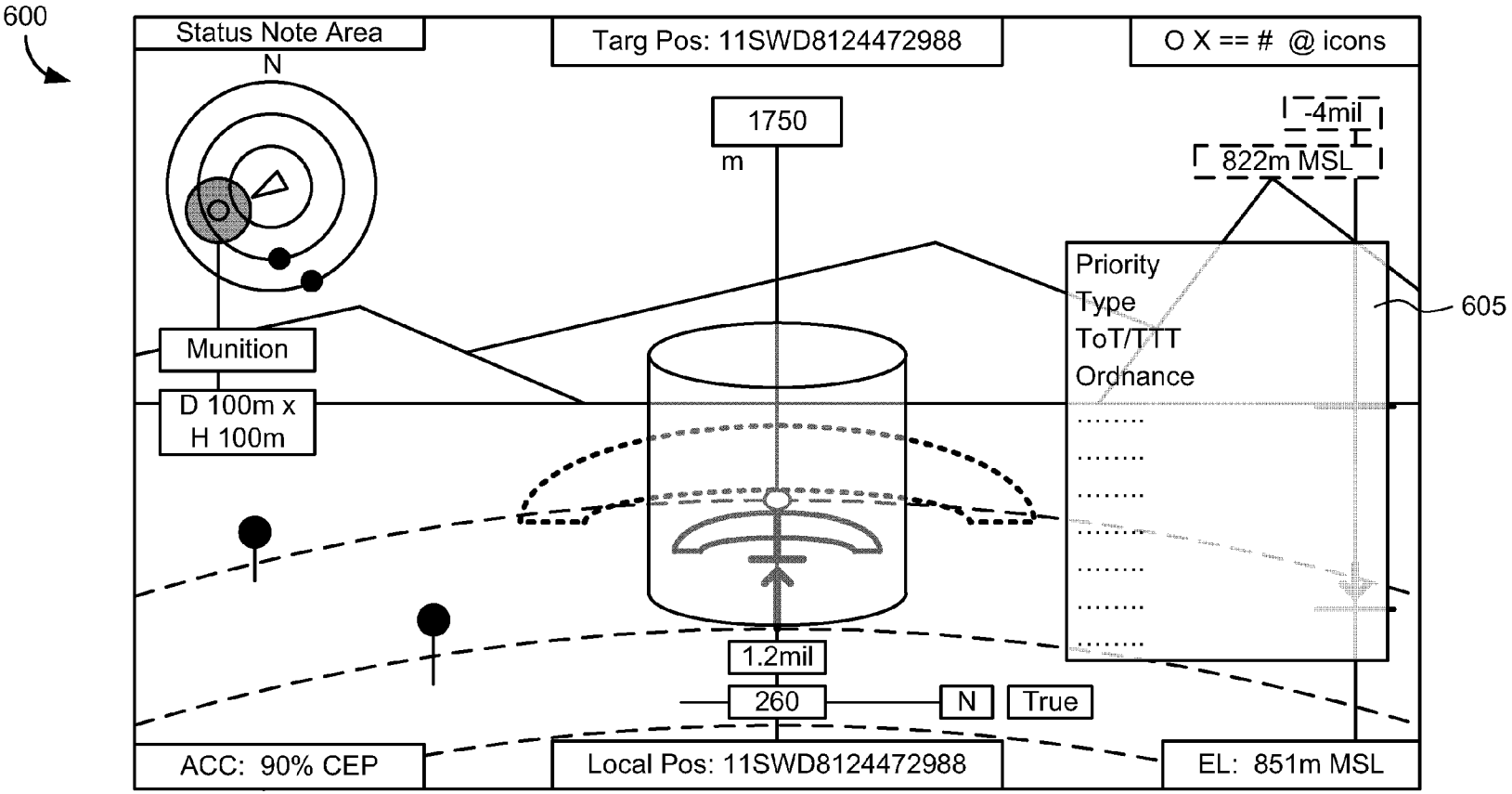

Referring now to FIG. 6, a targeting display image 600 is shown that includes the data shown in image 500 and also includes additional user-selectable information according to an exemplary embodiment. A detailed information field 605 can be used to present information relative to common reports such as call for fire, close air support, or any other formatted data as a transparent small text form within the field of view (e.g., off to the right hand side as shown in order to again retain center view). Detailed information field 605 may include selected fields each selectable for editing/entry by the user (or automatically by the system if applicable for various fields/data). The user can select to retain detailed information field 605 in the view once completed or have it removed. In some embodiments, the system can trigger presentation of select forms in a detailed information field if configured to do so, providing another mode of user alerting beyond the previously described status and icon information field areas. In some embodiments, the system may be configured to automatically populate information/data if possible using input data received from systems and/or sensors.

The disclosure is described above with reference to drawings. These drawings illustrate certain details of specific embodiments that implement the systems and methods and programs of the present disclosure. However, describing the disclosure with drawings should not be construed as imposing on the disclosure any limitations that may be present in the drawings. The present disclosure contemplates methods, systems and program products on any machine-readable media for accomplishing its operations. The embodiments of the present disclosure may be implemented using an existing computer processor, or by a special purpose computer processor incorporated for this or another purpose or by a hardwired system. No claim element herein is to be construed under the provisions of 35 U.S.C. §112, sixth paragraph, unless the element is expressly recited using the phrase "means for." Furthermore, no element, component or method step in the present disclosure is intended to be dedicated to the public, regardless of whether the element, component or method step is explicitly recited in the claims.

As noted above, embodiments within the scope of the present disclosure include program products comprising machine-readable storage media for carrying or having machine-executable instructions or data structures stored thereon. Such machine-readable storage media can be any available media which can be accessed by a general purpose or special purpose computer or other machine with a processor. By way of example, such machine-readable storage media can comprise RAM, ROM, EPROM, EEPROM, CD ROM or other optical disk storage, magnetic disk storage or other magnetic storage devices, or any other medium (e.g., non-transitory medium) which can be used to carry or store desired program code in the form of machine-executable instructions or data structures and which can be accessed by a general purpose or special purpose computer or other machine with a processor. Combinations of the above are also included within the scope of machine-readable storage media. Machine-executable instructions comprise, for example, instructions and data which cause a general purpose computer, special purpose computer, or special purpose processing machine to perform a certain function or group of functions.

Embodiments of the disclosure are described in the general context of method steps which may be implemented in one embodiment by a program product including machine-executable instructions, such as program code, for example, in the form of program modules executed by machines in networked environments. Generally, program modules include routines, programs, objects, components, data structures, etc., that perform particular tasks or implement particular abstract data types. Machine-executable instructions, associated data structures, and program modules represent examples of program code for executing steps of the methods disclosed herein. The particular sequence of such executable instructions or associated data structures represent examples of corresponding acts for implementing the functions described in such steps.

Embodiments of the present disclosure may be practiced in a networked environment using logical connections to one or more remote computers having processors. Logical connections may include a local area network (LAN) and a wide area network (WAN) that are presented here by way of example and not limitation. Such networking environments are commonplace in office-wide or enterprise-wide computer networks, intranets and the Internet and may use a wide variety of different communication protocols. Those skilled in the art will appreciate that such network computing environments will typically encompass many types of computer system configurations, including personal computers, hand-held devices, multi-processor systems, microprocessor-based or programmable consumer electronics, network PCs, servers, minicomputers, mainframe computers, and the like. Embodiments of the disclosure may also be practiced in distributed computing environments where tasks are performed by local and remote processing devices that are linked (either by hardwired links, wireless links, or by a combination of hardwired or wireless links) through a communications network. In a distributed computing environment, program modules may be located in both local and remote memory storage devices.

An exemplary system for implementing the overall system or portions of the disclosure might include a general purpose computing device in the form of a computer, including a processing unit, a system memory, and a system bus that couples various system components including the system memory to the processing unit. The system memory may include read only memory (ROM) and random access memory (RAM). The computer may also include a magnetic hard disk drive for reading from and writing to a magnetic hard disk, a magnetic disk drive for reading from or writing to a removable magnetic disk, and an optical disk drive for reading from or writing to a removable optical disk such as a CD ROM or other optical media. The drives and their associated machine-readable media provide nonvolatile storage of machine-executable instructions, data structures, program modules, and other data for the computer.

It should be noted that although the flowcharts provided herein show a specific order of method steps, it is understood that the order of these steps may differ from what is depicted. Also two or more steps may be performed concurrently or with partial concurrence. Such variation will depend on the software and hardware systems chosen and on designer choice. It is understood that all such variations are within the scope of the disclosure. Likewise, software and web implementations of the present disclosure could be accomplished with standard programming techniques with rule based logic and other logic to accomplish the various database searching steps, correlation steps, comparison steps and decision steps. It should also be noted that the word "component" as used herein and in the claims is intended to encompass implementations using one or more lines of software code, and/or hardware implementations, and/or equipment for receiving manual inputs.

The foregoing description of embodiments of the disclosure have been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated.

What is claimed is:

1. A method of displaying information on a targeting display, the method comprising:

positioning a targeted object proximate a center of a targeting display image;

providing a reticle below the targeted object in the targeting display image, wherein the reticle is configured to identify the targeted object to a user of the targeting display, and wherein the targeted object remains uncovered by the reticle;

providing a first plurality of data elements positioned along a vertical axis upon which the targeted object and reticle are also positioned, wherein the first plurality of data elements include a range to the target, an azimuth to the target, and one or more error estimates relating to at least one of the range to the target or the azimuth to the target; and providing a second plurality of data elements within a plurality of areas positioned proximate to one or more borders of the targeting display image.

2. The method of claim 1, wherein the reticle comprises a horizontally oriented first reticle element positioned below the targeted object and a vertically oriented second reticle element positioned below the first reticle element and oriented in line with the vertical axis, wherein the first reticle element is configured to assist in identifying a vertical position of the targeted object in the targeting display and the second reticle element is configured to assist in identifying a horizontal position of the targeted object in the targeting display image, and wherein the reticle is positioned such that neither the first reticle element nor the second reticle element cover the targeted object in the targeting display image.

3. The method of claim 1, wherein the second plurality of data elements include at least one of a status message, a position of the targeted object, a position of the targeting display, an elevation of the targeted object, an elevation of the targeting display, or a system accuracy estimate.

4. The method of claim 1, further comprising allowing a user to selectively enable or disable any of the first plurality of data elements and the second plurality of data elements.

5. The method of claim 1, further comprising providing a weapon effect indicator around the targeted object indicating an area around the targeted object that is expected to be affected if a selected weapon is used on the targeted object, wherein at least one of a size or shape of the weapon effect indicator is based on a type of selected weapon.

6. The method of claim 1, further comprising providing an object position indicator graphically illustrating relative positions of a plurality of objects with respect to a position of the targeting display, wherein the plurality of objects include the targeted object and one or more non-targeted objects.

7. The method of claim 6, further comprising:

providing a plurality of range rings graphically illustrating a plurality of ranges from the position of the targeting display; and providing object indicators for each of the one or more non-targeted objects at positions based on the relative positions of the non-targeted objects with respect to the position of the targeting display.

8. The method of claim 1, further comprising providing a vertical line connecting the first plurality of data elements to one another.

9. The method of claim 1, wherein one or more of the first plurality of data elements and the second plurality of data elements are presented in a semi-transparent data field such that at least one of the targeted object and a field of view surrounding the targeted object are at least partially visible under the semi-transparent data field.

10. The method of claim 1, further comprising providing a vertical line connecting one or more of the second plurality of data elements positioned proximate to a side border of the targeting display image.

11. The method of claim 1, further comprising:

receiving input data from a user relating to one or more of the first plurality of data items or the second plurality of data items; and modifying the one or more of the first plurality of data items or the second plurality of data items displayed in the targeting display image with respect to which the input data was received based on the input data.

12. A system, comprising:

an electronic processor configured to position a targeted object proximate a center of a targeting display image;

provide a reticle below the targeted object in the targeting display image, wherein the reticle is configured to identify the targeted object to a user of the targeting display, and wherein the targeted object remains uncovered by the reticle;

provide a first plurality of data elements positioned along a vertical axis upon which the targeted object and reticle are also positioned, wherein the first plurality of data elements include a range to the target, an azimuth to the target, and one or more error estimates relating to at least one of the range to the target or the azimuth to the target; and provide a second plurality of data elements within a plurality of areas positioned proximate to one or more borders of the targeting display image.

13. The system of claim 12, wherein the reticle comprises a horizontally oriented first reticle element positioned below the targeted object and a vertically oriented second reticle element positioned below the first reticle element and oriented in line with the vertical axis, wherein the first reticle element is configured to assist in identifying a vertical position of the targeted object in the targeting display and the second reticle element is configured to assist in identifying a horizontal position of the targeted object in the targeting display image, and wherein the reticle is positioned such that neither the first reticle element nor the second reticle element cover the targeted object in the targeting display image.

14. The system of claim 12, wherein the second plurality of data elements include at least one of a status message, a position of the targeted object, a position of the targeting display, an elevation of the targeted object, an elevation of the targeting display, or a system accuracy estimate.

15. The system of claim 12, wherein the electronic processor is further configured to allow a user to selectively enable or disable any of the first plurality of data elements and the second plurality of data elements.

16. The system of claim 12, wherein the electronic processor is further configured to provide a weapon effect indicator around the targeted object indicating an area around the targeted object that is expected to be affected if a selected weapon is used on the targeted object, wherein at least one of a size or shape of the weapon effect indicator is based on a type of selected weapon.

17. The system of claim 12, wherein the electronic processor is further configured to provide an object position indicator graphically illustrating relative positions of a plurality of objects with respect to a position of the targeting display, wherein the plurality of objects include the targeted object and one or more non-targeted objects.

18. The system of claim 17, wherein the electronic processor is further configured to:

provide a plurality of range rings graphically illustrating a plurality of ranges from the position of the targeting display; and provide object indicators for each of the one or more non-targeted objects at positions based on the relative positions of the non-targeted objects with respect to the position of the targeting display.

19. One or more computer-readable storage media having instructions stored thereon, the instructions being executable by one or more processors to execute a method comprising:

positioning a targeted object proximate a center of a targeting display image;

providing a reticle below the targeted object in the targeting display image, wherein the reticle is configured to identify the targeted object to a user of the targeting display, and wherein the targeted object remains uncovered by the reticle;

providing a first plurality of data elements positioned along a vertical axis upon which the targeted object and reticle are also positioned, wherein the first plurality of data elements include a range to the target, an azimuth to the target, and one or more error estimates relating to at least one of the range to the target or the azimuth to the target; and providing a second plurality of data elements within a plurality of areas positioned proximate to one or more borders of the targeting display image.

20. The one or more computer-readable storage media of claim 19, wherein the reticle comprises a horizontally oriented first reticle element positioned below the targeted object and a vertically oriented second reticle element positioned below the first reticle element and oriented in line with the vertical axis, wherein the first reticle element is configured to assist in identifying a vertical position of the targeted object in the targeting display and the second reticle element is configured to assist in identifying a horizontal position of the targeted object in the targeting display image, and wherein the reticle is positioned such that neither the first reticle element nor the second reticle element cover the targeted object in the targeting display image.

21. The one or more computer-readable storage media of claim 19, wherein the second plurality of data elements include at least one of a status message, a position of the targeted object, a position of the targeting display, an elevation of the targeted object, an elevation of the targeting display, or a system accuracy estimate.

22. The one or more computer-readable storage media of claim 21, wherein the method further comprises providing a weapon effect indicator around the targeted object indicating an area around the targeted object that is expected to be affected if a selected weapon is used on the targeted object, wherein at least one of a size or shape of the weapon effect indicator is based on a type of selected weapon.

* * * * *